United States Patent [19]

Draghiccio et al.

[11] 4,220,102

[45] Sep. 2, 1980

[54] LOOPER CONTROL APPARATUS FOR SEWING MACHINES

[75] Inventors: Pietro Draghiccio; Enrico Villa, both of Corsico, Italy

[73] Assignee: Rockwell-Rimoldi S.p.A., Milan, Italy

[21] Appl. No.: 45,906

[22] Filed: Jun. 6, 1979

[30] Foreign Application Priority Data

Jun. 13, 1978 [IT] Italy ..... 24491 A/78

[51] Int. Cl.[3] ..... D05B 1/06; D05B 1/10

[52] U.S. Cl. ..... 112/200

[58] Field of Search ..... 112/200, 316, 317

[56] References Cited

U.S. PATENT DOCUMENTS

| | | | |
|---|---|---|---|
| 3,301,207 | 1/1967 | Reeber et al. | 112/200 |
| 3,460,497 | 8/1969 | Orth et al. | 112/200 |

*Primary Examiner*—Ronald Feldbaum

[57] ABSTRACT

A looper control apparatus for sewing machines which are adapted to form seams of double chain stitches both in a forwardly and reverse direction of sewing. The apparatus includes first and second driving devices for effecting travel of the looper in an elliptical pathway while sewing in a forwardly direction. A disconnecting mechanism is effective upon a selection to sew in a reverse direction in deactivating the second driving device so that the looper is actuated only by the first driving device which causes it to travel in a rectilinear pathway on one side only of the machine's needle.

8 Claims, 14 Drawing Figures

LOOPER CONTROL APPARATUS FOR SEWING MACHINES

BACKGROUND OF THE INVENTION

The present invention pertains to a sewing machine for forming seams of the double chain stitch type which can be selectively caused to sew in a reverse direction and more particularly the invention relates to an improved means for effecting the formation of such stitches during reverse sewing.

Known types of such sewing machines generally include at least one needle and a looper with each having a separate thread source for the formation of double chain stitches. Additionally they have separate actuating mechanisms for these members one of which causes the needle to travel in a rectinlinear pathway that is perpendicular to the direction of sewing, and the other is effective in causing the looper to travel in an elliptical pathway which is perpendicular to both the direction of sewing and the pathway of the needle.

These known types of sewing machines are also provided with conventional feed devices for advancing a workpiece during the sewing cycle which include means adapted to selectively reverse the direction of movement of a workpiece being sewn thus effecting a reversal in the direction of sewing.

In particular, the known machines are provided with first and second similar actuating devices for the looper that perform their functions simultaneously to provide a compound movement of the looper. The first device effects movement of the looper in a direction perpendicular to the direction of sewing and the second device in a direction parallel to said direction of sewing. The combination of these two movements generates an ellipitical pathway of travel for the looper which, as is well known to those conversant in the art, is effective in first causing said looper to take the loop of thread carried by the needle and then to form a triangle of threads into which said needle is caused to descend during each of its downward strokes.

The so-called triangle of threads is a common term associated with stitches of the double chain type and is formed by the combination of the looper, looper thread and needle thread. The looper forms the base of the triangle and the sides by the two threads with the vertex thereof being united with the last stitch formed thus causing said triangle to extend in the direction of sewing.

Additionally the known machines are provided with thread displacing means which serve to orient the triangle of threads on the same side of the needle and looper both during forward and reverse stitching. These thread displacing means are caused to function in synchronism with other elements of a machine while forming a seam and as a result are also active when their function is not required, i.e., when the machine is being operated to advance the workpiece in a forwardly direction. This condition frequently results in an interference with the proper formation of stitches in a forwardly direction due to the fact that these thread displacing means continue to function in a slightly different plane. These thread displacing means have been found to be especially troublesome when operating machines which utilize more than a single needle, for a triangle of threads must be formed for each needle, and the closeness of the triangles along with additional thread displacing means creates a condition making stitch formation difficult and uncertain when sewing in a reverse direction.

An object of the present invention is to simplify double chain stitch sewing machines which are adapted to be operated both in a forward and reverse direction whereby they will perform their intended functions in a more positive and reliable manner.

SUMMARY OF THE INVENTION

The object of the invention is accomplished by providing means which when a selection is made to operate the machine in reverse, the looper will be caused to travel solely in a rectilinear pathway and the triangle of threads formed will be caused to extend in the direction of movement of the workpiece thereby creating the most desirable conditions for the formation of stitches both in a forward and reverse direction of operation.

The looper in its rectilinear pathway travels in the same plane both in its forward and return strokes and the means for effecting this movement is operatively connected to the means for reversing the direction of sewing whereby both means are adapted to function simultaneously so as to cause the correct penetration of the needle into the triangle of threads which is oriented in the selected direction of sewing.

The principal advantage of the invention is that of being able to satisfactorily link together the threads forming a double chain stitch without the need of the aforementioned thread displacing means that function within the area of the sewing zone and which are caused to orient the triangle of threads in the same direction during both forward and reverse sewing. This is deemed particularly advantageous for both the needle and the looper are actuated to move in their respective trajectories or pathways by means disposed in spaced relation to the sewing zone.

These and other objects of the present invention will become more fully apparent by reference to the appended claims and as the following detailed description proceeds in reference to the figures of drawing wherein;

DESCRIPTION OF THE PREFERRED EMBODIMENT

Figure 1:
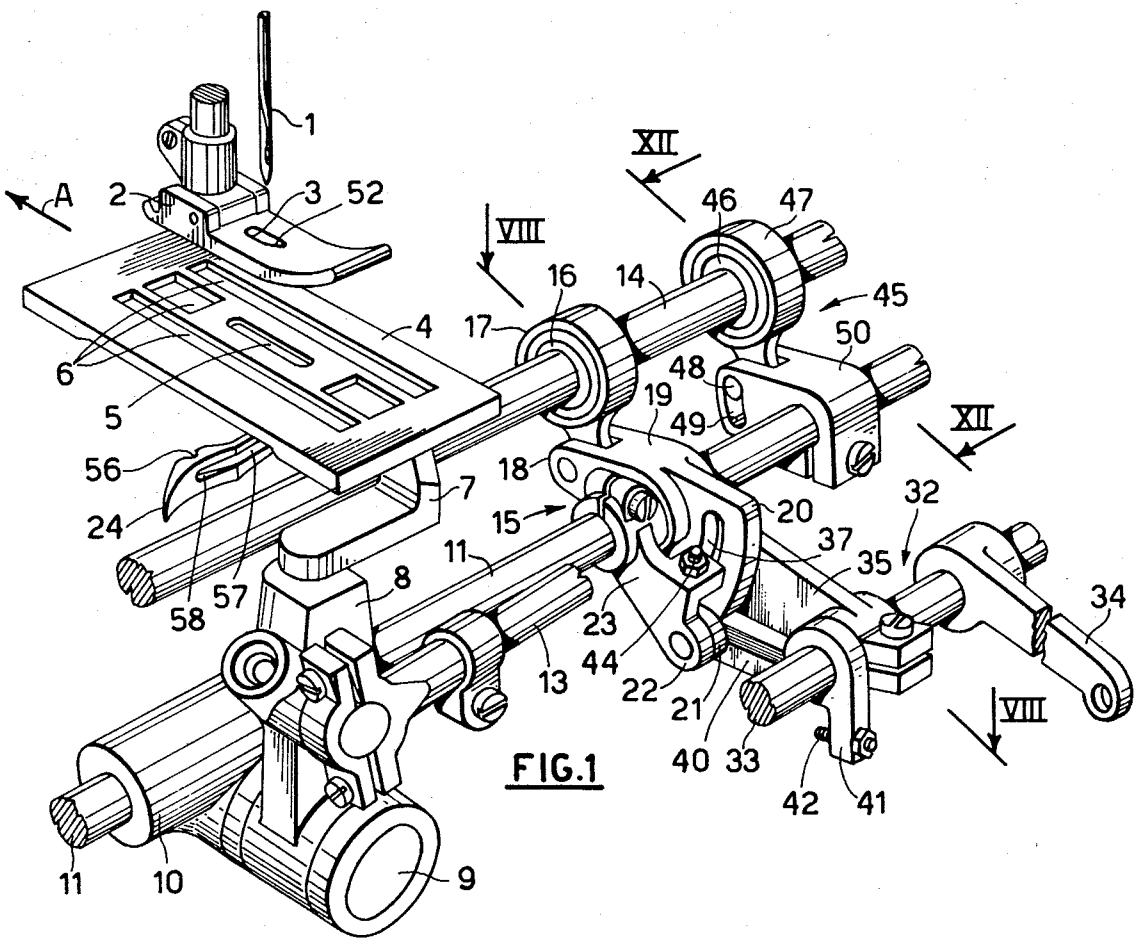
FIG. 1 is a perspective view of a portion of a sewing machine showing some of the elements for effecting actuation of the looper.

Now referring to the figures of drawing enough of a sewing machine for forming stitches of the double chain type which can be selectively caused to sew both in a forwardly and reverse direction is shown in FIG. 1 to serve as a basis for a detailed description of the invention applied thereto.

Figure 6:
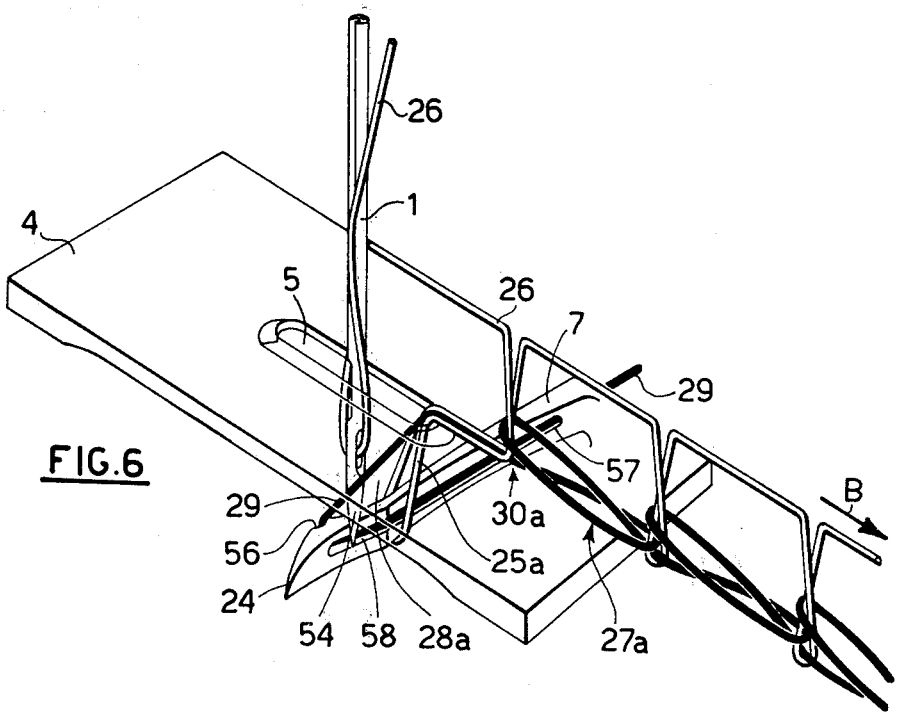
Figure 13:
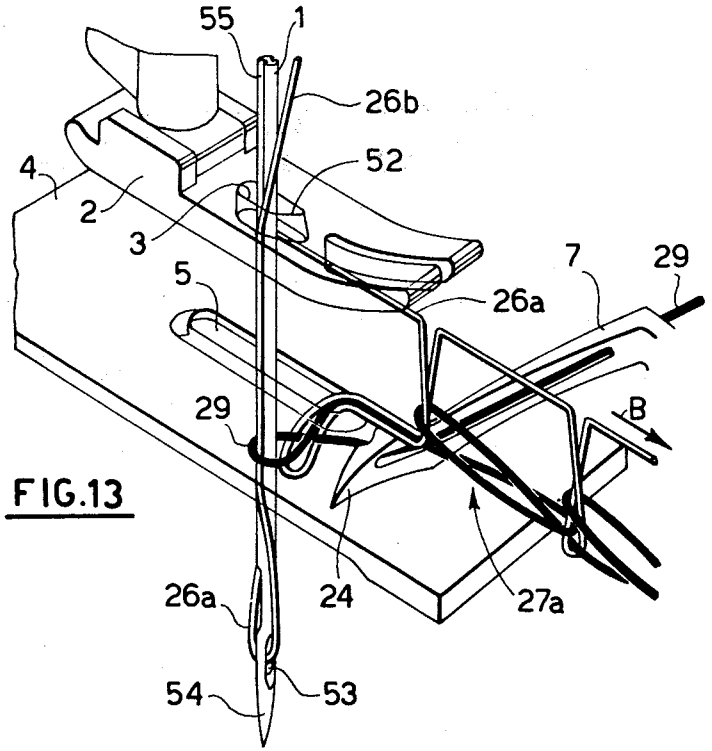

As shown in this figure of drawing the machine includes among its many parts a needle 1 and a presser foot 2 which includes the usual opening 3 through which said needle is caused to pass while performing its intended function. A needle plate 4 is located in a conventional manner beneath the presser foot 2 and is provided with an opening 5 in alignment with opening 3 which in a known manner also serves to permit passage of the needle therethrough. The needle plate also includes the usual openings 6 within which well known feed dogs (not shown) perform their function of advancing a workpiece (not shown) during the sewing cycle. In FIG. 1 the indicating arrow A depicts the direction of sewing in a forwardly direction and the indicating arrow B in FIGS. 6 and 13 depicts the reverse direction of sewing.

The machine also includes a looper 7 beneath the needle plate 4 that is mounted so as to extend in a direction perpendicular to the direction of sewing A. The looper 7 cooperates with the needle 1 in the formation of double chain stitches such as those identified by numeral 401 in the Federal Standard Catalog of the United States of America.

The looper 7 is fixedly mounted on the upper end of a support 8 that is pivotably assembled on a pin 9. The pin 9 extends in a direction parallel with the direction of sewing A and is supported at one end in a boss formed on the underside of a sleeve 10 that is fixed on an oscillatably driven shaft 11. This shaft 11 is supported by the frame (not shown) of the machine and extends in a direction perpendicular to the direction of sewing A.

In operation a suitable actuating means (not shown) causes the needle 1 to alternatively travel in two directions along a pathway which passes through openings 3 and 5 which is generally perpendicular to the direction of sewing.

The looper 7 is alternatively displaced along a substantially elliptical pathway 12 (FIG. 2) beneath the needle plate 4 which perpendicularly winds about the pathway followed by the needle 1. This elliptical pathway is spaced from, but perpendicular to the aforesaid direction of sewing.

The elliptical displacement of the hook is generated by the combination of two separate driving means acting on the support 8 and which function in mutual synchronism. The support 8 is caused to oscillate on the pin 9 by the first driving means to effect an alternating back and forth movement of the looper that is perpendicular to the direction of sewing A and to the needle 1. This movement is also effective in causing the looper to take and then release the so-called loop of needle thread. This first driving means includes a rod 13 pivotably at one end to the support 8 and operatively connected at its opposite end to a conventional drive mechanism (not shown) of the eccentric and connecting rod type. This drive mechanism is mounted on the main shaft 14 of the sewing machine and is effective in transforming the rotations of the shaft into reciprocating movement for rod 13 and pivoting movement of the support 8.

Simultaneously the support 8 is caused to oscillate about the axis of the shaft 11 by the second driving means identified generally by numeral 15, to effect movement of the looper in a direction parallel to the direction of sewing A, whereby said looper will pass in front of the needle after a loop of needle thread has been taken in order to permit said needle to penetrate the so-called triangle of threads during its downward movement toward the looper.

This second driving means 15 includes a drive eccentric 16 fixed on the main shaft 14, and with one end of a connecting rod 17 mounted on the eccentric. The opposite end of this connecting rod 17 is pivotably connected to an end 18 of a balance lever 19 that is mounted for pivotal movement on the oscillatably driven shaft 11.

The opposite end of the balance lever 19 is depicted by numeral 20 and is operatively associated with a connecting rod 21 that is pivotably mounted on the free end 22 of a lever 23 which is fixed on the oscillatably driven shaft 11. The combination of these two driving means first causes the looper to advance in the pathway depicted by number **12*a* in FIG. 2 which relative to the direction of sewing A is disposed rearwardly of the needle 1. The free end or tip of the looper is identified by numeral 24 and during its travel in pathway 12*a* said tip is caused to enter the loop 25 of needle thread as the needle is moving in an upwardly direction. As the needle 1 continues upwardly the loop 25 of needle thread is retained by the looper. The looper is then caused to return to its initial position by the second driving means which causes it to travel in the pathway depicted by numeral 12*b* in FIG. 2 which is located on that side of the needle's pathway opposite to the pathway 12*a***.

Figure 4:
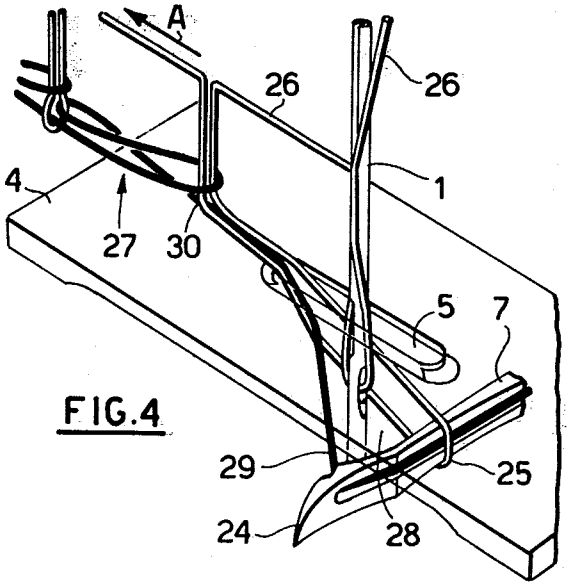
FIGS. 3 and 4 are diagrammatic views showing two phases of stitch formation when sewing in a forwardly direction.
Figure 3:
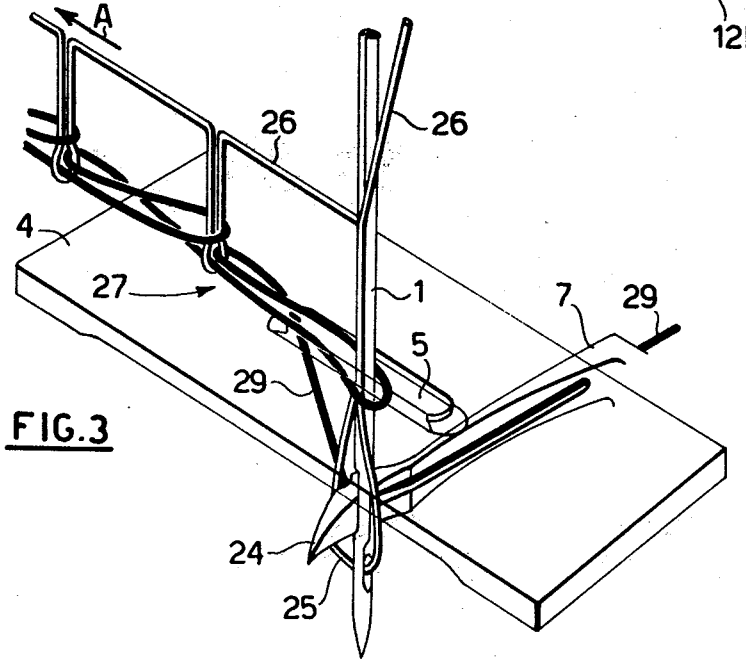
Figure 5:
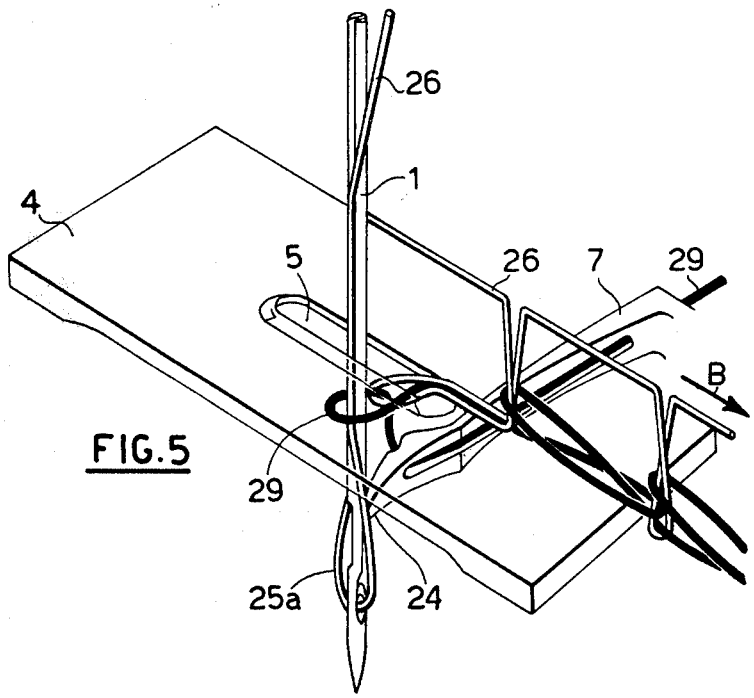
FIGS. 5 and 6 are views similar to FIGS. 3 and 4 but showing two phases of stitch formation when sewing in a reverse direction.

As the looper is travelling in pathway **12*b*, the needle 1 is caused to descend for the purpose of initiating formation of the next stitch. This downward movement of the needle 1 locates it intermediate the looper and the previously formed stitch, identified generally in FIGS. 3 and 4 by numeral 27, and which has been advanced in the direction of sewing A by the feed dogs of the machine. This combination of movements of the needle and the looper in pathway 12*b* causes said looper to form a triangle of threads 28 into which said needle is adapted to descend as shown in FIG. 4**.

As is known, the base of a triangle of threads is formed by the looper and the sides thereof by a looper thread 29 and the needle thread loop 25. These threads are disposed in spaced relation on the looper and extend therefrom one toward the other to form a vertex 30 that unites these threads with the previously formed stitch 27 thus causing the triangle to be extended in the direction of sewing A.

Figure 14:
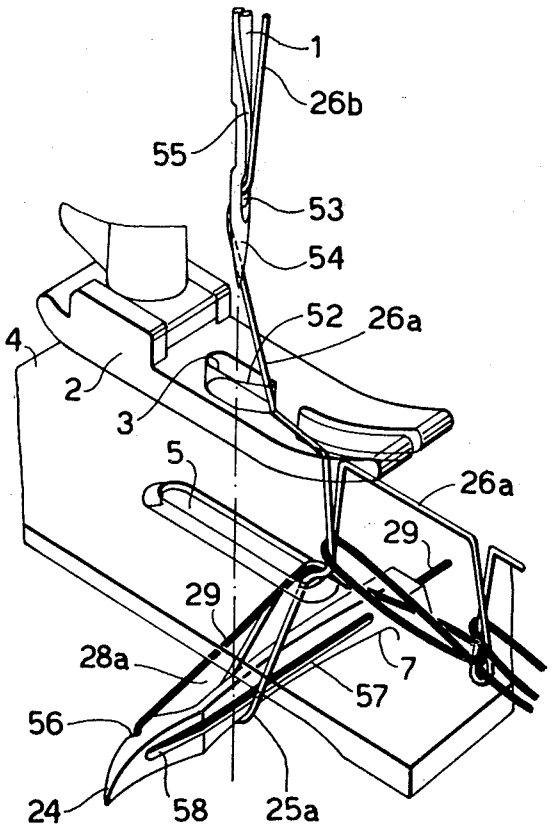
FIGS. 13 and 14 are perspective views showing the improved presser foot and needle plate according to the invention.

As heretofore set forth, the indicating arrow B depicts the direction of sewing in reverse and the triangle of threads formed during sewing in this manner is identified in FIGS. 6 and 14 by numeral **28*a*. As shown in these figures of drawing the triangle of threads 28*a*** is caused to extend in the opposite direction of the triangle formed while sewing in the forwardly direction.

Due to the manner in which the needle thread 26 is threaded through the eye of the needle 1, it is necessary during both directions of sewing that the looper 7 be caused to travel on the same side of the needle when taking the loop of needle thread to initiate the formation of a stitch. To produce the necessary concatention of the seam of stitches during reverse sewing it was found that the desired stitches could be formed by causing the looper to return to its starting position in the same pathway that it followed to enter and take the loop of needle thread.

Figure 7:
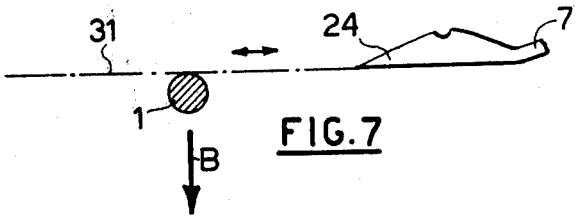

To effect movement of the looper in the preferred manner during reverse sewing, the second driving means 15 includes means operatively associated with the eccentric 16 and suitable for controlling, in addition to the needle 1, the return stroke of the looper to its starting position. This means for controlling the looper according to the invention defines a disconnecting device generally indicated in FIGS. 1 and 8 by numeral 32 and is effective in interrupting the oscillations generated by the eccentric 16 so as to prevent movement of the looper 7 in a direction parallel with the direction of sewing. This results in the looper being caused to follow a rectilinear pathway that is identified in FIG. 7 by numeral 31 wherein the forward and return strokes of the looper coincide. This manner of actuating also causes the needle 1 to penetrate the triangle of threads during its downward stroke in a manner which will be more fully described hereinafter.

This disconnecting device 32 includes a drive shaft 33 that is operatively connected to a known and conventional means for reversing the direction of movement of a workpiece which forms a part of the conventional workpiece feed means and serves to provide simultaneity of action of both the means for effecting reversal of direction and the proper disposition of the looper relative to the needle.

An operating lever 34 and a disconnect lever 35 are keyed on the drive shaft 33 and said disconnect lever 35 is actuated by the means described supra for effecting movement of the looper parallel to the direction of sewing and which are constituted by the eccentric 16 and the support 8 for said looper.

Figure 8:
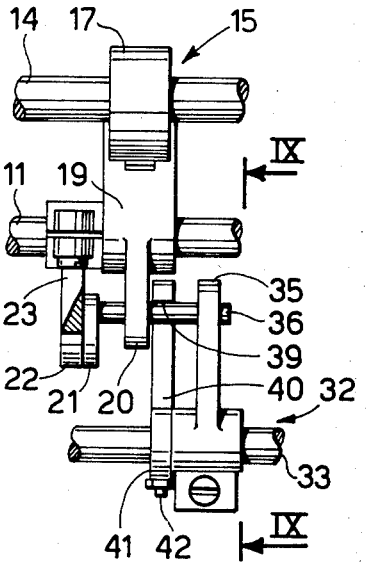
FIG. 8 is a top view showing the various elements of the device for effecting the changing of the looper's travel from one pathway to the other.

The operating lever 34 is accessible from the exterior of the sewing machine and can be selectively actuated when it is desired to sew in a reverse direction. The disconnect lever 35 is operatively associated with a pivot element 36 (FIGS. 9 and 10) carried by the connecting rod 21 which is pivotably attached to the lever 23 (FIG. 8).

The pivot element 36 extends through a slot 37 of generally S-shaped configuration that is formed in an end 20 of the balance lever 19. This pivot element 36 projects from each side of the slot 37 and is engaged in an arcuate slot 38 (FIGS. 9 and 10) provided in the disconnect lever 35 and serves to control the displacement of said pivot element along the length of said slot 37. This arcuate slot 38 is disposed so that when the disconnect lever 35 is in its lowered position (FIG. 9) it is concentric with the oscillatably driven shaft 11 and the pivot element 36 is in a position whereby it is caused to follow the oscillating movements of the balance lever 19.

Figure 11:
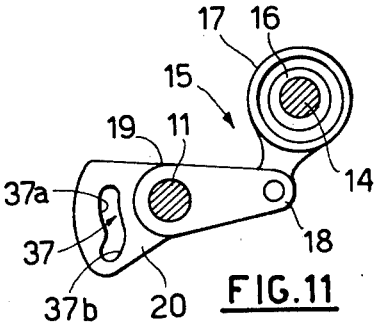
FIGS. 9, 10 and 11 are views in side elevation of elements shown in FIG. 8.

With reference to FIG. 11, the slot 37 includes an upper curved portion **37*a* which is concentric with the oscillatably driven shaft 11 and with a lower curved portion that is depicted by numeral 37*b*** which is radially extended relative to said shaft.

The curved portion **37*a* as a result of its concentricity, locates the inoperative or disconnecting position of the connecting rod 21, because the pivot element 36 when displaced into this portion is not affected by the oscillating movements of the balance lever 19**.

On the other hand, the lower curved portion **37*b* locates the operative position of all the driving means because the pivot element 36, when it is in this position is caused to follow the oscillations transmitted to the balance lever 19 from the eccentric 16**.

From what has been described above, the lowering of the operating lever 34 effects the displacement of the pivot element 36 from its operative position to its inoperative one, and thus causing the disconnection of the second driving means 15 and the reversal of the direction of sewing, i.e., the initiation of reverse sewing.

Figure 9:
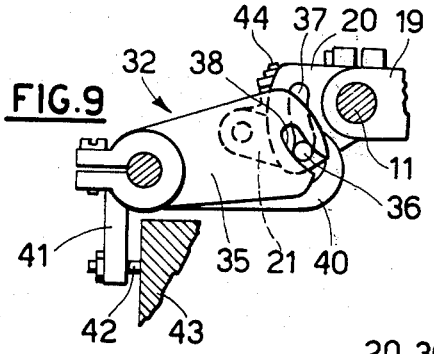
Figure 10:
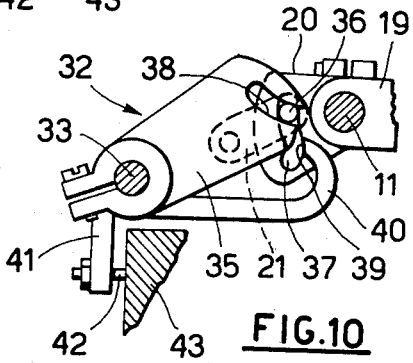

To permit shifting from one direction of sewing to the other when the looper is disposed so as not to interfere with the needle 1, the disconnecting device 32 is provided with a limiting or safety element 39. This safety element 39 is located adjacent the pivot element 36 and serves to prevent the latter from being displaced from one to the other of the portions of slot 37 when such displacement would cause an interference with the needle 1 (FIGS. 9 and 10).

Figure 2:
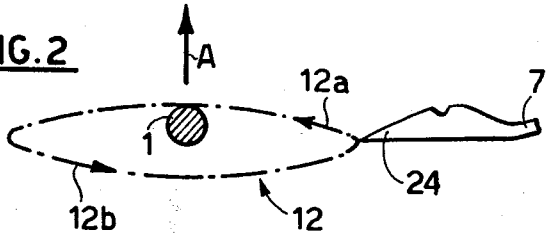
FIGS. 2 and 7 are diagrammatic views of the two pathways, which respectively, the needle and looper are caused to follow during forward and reverse directions of sewing.

The location of the safety element 39 relative to the pivot element 36 is such as to prevent initiation of reverse sewing when the looper is moving in the pathway **12*b* (FIG. 2), for actuation of operating lever 34 during this time to effect rectilinear travel of said looper would cause an interference with the needle 1. Additionally, the position of the safety element 39 also serves to prevent the return to sewing in a forward direction when the looper is moving in the rectilinear pathway 31 for there would be an interference with the needle 1 at this time if an attempt was made to cause said looper to travel in its elliptical pathway 12 (FIG. 2). The safety element 39 controls movement of the pivot element 36 so that its displacement in the slot 37 occurs only during a brief arc of rotation of the eccentric 16 and is effective in preventing the possibility of a collision between the needle and looper when selectively shifting from one direction of sewing to the other. The safety element is carried by an arm 40 which is pivotably mounted on the drive shaft 33 adjacent the disconnect lever 35, and includes an appendage 41 having a regulating screw 42 that is conventionally biased by spring means (not shown) against a fixed part 43** of the sewing machine.

This regulating screw 42 serves to regulate the position at which the disconnecting device 32 is caused to act on the second driving means 15 for the looper. For the purpose of acurately regulating the optimal distance separating the looper from the needle during reverse sewing, which is a distance corresponding with that provided during sewing in the forward direction, the disconnecting device 32 includes another limiting or safety element which is carried by the lever 23 that is fixed on the oscillatably driven shaft 11 and serves to control the position of the pivot element 36 within the arcuate portion of the slot.

This safety element is formed by a positioning screw 44 which bears against the connecting rod 21 so as to stabilize its angular position with respect to the lever 23 and provide an appropriate amount of resistance for the driving elements in the desired position, which include the lever 23, the oscillatably driven shaft 11 and the support 8.

To ascertain that an excessive pressure on the operating lever 34 will not negatively influence the effective distance described supra, the disconnecting device 32 also includes a positioning device 45 (FIGS. 1 and 12) which serves to prevent overtravel of the oscillatably driven shaft 11 which would cause the looper to follow its rectilinear pathway at a greater distance from the needle than is intended.

Figure 12:
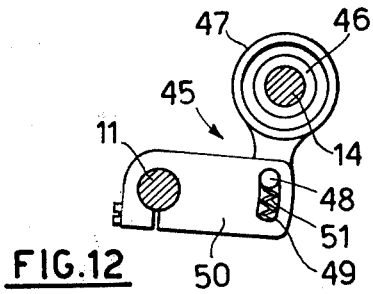
FIG. 12 is a view in side elevation of the device for controlling the position of the looper.

This positioning device 45 is formed by a cylindrical sleeve 46 that is fixed on the main shaft 14 with one end of a rod 47 operatively connected thereto. The opposite end of rod 47 carries a pivot pin 48 which serves as a tie to fix the maximum distance which separates the looper from the needle. The pivot pin 48 extends parallel to the oscillatably driven shaft 11 and as shown in FIGS. 1 and 12 it is disposed for sliding movement within an arcuated slot 49 provided in an arm 50 that is adjustably mounted on said oscillatably driven shaft.

During sewing in the forward direction, the shaft 11 is oscillated continuously, and its oscillations determine an alternating movement of the slot 49 with respect to the pivot pin 48 which remains stationary.

On the other hand, in the case of disconnection of the second driving means 15 for effecting sewing in a reverse direction, the slot 49 is supported on the pivot pin 48.

As this condition could be altered by the weight of the support 8 exerting its influence eccentrically with respect to the shaft 11 and in a direction such as to alter the contact between the upper limit of the slot 49 and the pivot pin 48 so as to bring the looper closer to the needle, a biasing means has been provided that is located intermediate the lower limit of the slot 49 and the pivot pin 48.

This biasing means defines a helical spring 51 and serves to neutralize the effect of the weight of the support 8 so that positive contact is provided between the slot 49 and the pivot pin 48 when the second driving means 15 is disconnected.

The sewing machine to which the present invention is applicable includes thread manipulating means forming a part of both the presser foot 2 and on the looper 7 and which perform their intended function during reverse sewing upon actuation of the disconnecting device 32.

The thread manipulating means forming a part of the presser foot 2 (FIGS. 13 and 14) comprises an elongation of opening 3 in the direction B of reverse sewing which is perpendicular to the plane of the needle plate 4 and is tapered in said direction B as indicated by numeral 52 in these figures of drawing. As shown in FIG. 14 this thread manipulating means serves to guide that portion of the needle thread 26*a* emerging from the eye 53 of the needle 1 to the right, as viewed in this figure of drawing, when said needle is disengaged from the workpiece.

This feature is necessary to avoid a possibility of the portion 26*a* of the needle thread from being accidentally displaced to the left of the tip 54 of the needle 1 and is effective in properly locating the thread loop that will be taken by the looper during the succeeding phase of stitch formation.

In accordance with this feature, the needle 1 has been provided with two conventional grooves which are disposed symmetrically helicoidal for accommodating the needle thread and of these, only the one depicted by numeral 55 in FIGS. 13 and 14 can be seen.

Each of the grooves 55 starts from the eye 53 and ends on the shank of the needle 1 and serves to maintain the two portions of thread 26*a* and 26*b* in separation so as to prevent interference one with the other during the phase of penetration of the needle into the workpiece. Each of the portions of needle thread 26*a* and 26*b* automatically enters its respective groove and is maintained therein both by the tension which is generated during each penetration of the needle into the fabric of the workpiec. and by the friction produced by the frictional engagement of said portions with the workpiece. The thread-manipulating means provided on the looper 7 (FIGS. 1 and 6) defines a recess 56 formed in the upper part of the looper's tip portion 24 and on that side of the latter from which the looper thread 29 is withdrawn.

This thread 29 is caused to enter the recess 56 during the retrograde movement of the looper 7 to form the triangle of threads 28*a*, and provides specially during the formation of very short stitches, a means for assuring a sufficient spreading of the sides of the triangle of threads for the correct formation of the stitches of the seam.

During this phase, the looper thread 29, which extends through a channel 57 within the looper loses a portion of its tension and could easily create a condition whereby the tip 54 of the needle, during the latter's downward travel, would interfere with said looper thread.

To prevent the possibility of such a condition that portion of the channel 57 within the leading end or tip 24 of the looper 7 has been formed to extend at an angle obligue to the remainder of said channel as depicted by numeral 58 in FIGS. 1 and 6 and is effective in maintaining said thread within the tip and clear of the needle pathway.

The sewing machine to which the presention invention is applicable has been described as including an improved means for effecting the formation of stitches during reverse sewing. By changing the ellipcial pathway followed by the looper when sewing in a forwardly direction to a solely rectilinear pathway disposed perpendicular to the direction of sewing when it is desired to sew in this manner.

It should be understood that it is also possible to form the stitches of a seam during reverse sewing by causing the looper to travel in an elliptical pathway. Such a pathway would be similar to that in FIG. 2 but rotated 180° so that the looper is displaced a greater distance from the needle in a direction opposite to the direction B of sewing. In other words this elliptical pathway would be disposed so as to be above the needle 1 as viewed in FIG. 2 and the looper would travel in its return pathway 12*b* on the same side of the needle as it did in pathway 12*a* to take a loop of needle thread. To effect travel of the looper in this manner is easily accomplished by resetting the eccentric 16 of the second driving means 15 180° from its original position on the main shaft 14 of the sewing machine.

A change to this elliptical pathway of travel for the looper can also be accomplished by nullifying the eccentricity of the eccentric 16, which is of the so-call adjustable eccentricity type, and arrange it in a reciprocal position diametrically opposed with respect to the shaft 14.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A looper control apparatus for sewing machines of the type for forming seams of double chain stitches in both a forwardly and reverse direction of sewing, having a presser foot and a needle plate and at least one needle with an independent thread service, reciprocably driven in a rectilinear pathway between positions above and below the needle plate, said looper control apparatus comprising:

(a) a looper having an independent thread source mounted beneath the needle plate for movement perpendicular to the pathway of the needle to take a loop of thread from the latter and form a triangle of threads to be penetrated by the needle;

(b) a first driving means connected to said looper for effecting alternating back and forth movement thereof perpendicular to the direction of sewing;

(c) a second driving means connected to said looper for moving the same parallel to the direction of sewing with the combination of said first and second driving means forming an elliptical pathway for said looper, winding about the rectilinear pathway of the needle, when sewing in a forwardly direction; and (d) disconnecting means operatively connected to said second driving means for deactivating the latter when sewing in a reverse direction to effect actuation of said looper solely by said first driving means in a rectilinear pathway and at one side only of the needle.

2. The looper control apparatus according to claim 1 wherein said second driving means includes a shaft (11) to which said looper is operatively connected, and a rotatably driven eccentric (16) with means interconnecting it with said shaft (11) for effecting oscillating movement thereof and displacement of said looper to each side of the needle when travelling in its elliptical pathway.

3. The looper control apparatus according to claim 2 wherein said means interconnecting said shaft (11) with said eccentric (16) defines a balance lever (19) having an end (20) with means defining an S-shaped slot (37) operatively associated with a pivot element (36) of said disconnecting means, said pivot element (36) including means for effecting its displacement to positions within said slot (37) for causing said balance lever (19) to effect oscillating movement of said shaft (11) by said eccentric (16) and to render said balance lever (19) ineffective on said shaft (11) to effect actuation of said looper solely by said first driving means.

4. The looper control apparatus according to claim 3 wherein said disconnecting means includes a drive shaft (33) having a manual operating lever (34) and a disconnect lever (35) fixed thereon, said disconnect lever (35) including means defining an arcuate slot (38) operatively associated with said pivot element (36) to form an operative connection therebetween.

5. The looper control apparatus according to claim 4 wherein said disconnecting means includes a safety element (39) mounted on said drive shaft (33) and in operative association with said pivot element (36) to prevent the latter from being displaced from one to the other of its positions when a condition of interference exists between said looper and the needle.

6. The looper control apparatus according to claim 5 wherein said disconnecting means includes a safety element formed by a position screw (44) carried by a lever (23) fized on said shaft (11) for effecting control of the position of said pivot element (36) within said slot (37).

7. The looper control apparatus according to claim 6 wherein said apparatus includes a looper position adjusting device (45) operatively associated with said disconnecting means for preventing said looper from being displaced from its rectilinear pathway during sewing in a reverse direction.

8. The looper control apparatus according to claim 1 wherein said looper includes a thread manipulating means defining a recess (56) for receiving and guiding the looper thread during retrograde movement of said looper in its rectilinear pathway to effect a spreading of the sides of the triangle of threads when sewing in a reverse direction.

* * * * *